US012286800B2

(12) United States Patent
Carpentier et al.

(10) Patent No.: US 12,286,800 B2
(45) Date of Patent: Apr. 29, 2025

(54) PANEL FOR PRODUCING SELF-LOCKING FLOOR COVERING

(71) Applicant: Gerflor, Villeurbanne (FR)

(72) Inventors: Fabien Carpentier, Bollene (FR); Michel Wengryn, Lapalud (FR)

(73) Assignee: Gerflor, Villeurbanne (FR)

( * ) Notice: Subject to any disclaimer, the term of this patent is extended or adjusted under 35 U.S.C. 154(b) by 204 days.

(21) Appl. No.: 17/785,139

(22) PCT Filed: Dec. 14, 2020

(86) PCT No.: PCT/FR2020/052431
§ 371 (c)(1),
(2) Date: Jun. 14, 2022

(87) PCT Pub. No.: WO2021/130431
PCT Pub. Date: Jul. 1, 2021

(65) Prior Publication Data
US 2023/0008174 A1 Jan. 12, 2023

(30) Foreign Application Priority Data
Dec. 23, 2019 (FR) ..... 1915491

(51) Int. Cl.
*E04F 15/02* (2006.01)
*E04F 15/10* (2006.01)

(52) U.S. Cl.
CPC ..... *E04F 15/02038* (2013.01); *E04F 15/105* (2013.01); *E04F 2201/0146* (2013.01);
(Continued)

(58) Field of Classification Search
CPC ..... E04F 15/105; E04F 2201/0146; E04F 2201/0161; E04F 2201/023; E04F 2201/042; E04F 2201/043
(Continued)

(56) References Cited

U.S. PATENT DOCUMENTS 1,615,096 A * 1/1927 Meyers ..... E04F 15/04 52/434
3,694,983 A * 10/1972 Couquet ..... E04F 15/10 428/57
(Continued)

FOREIGN PATENT DOCUMENTS

EP 0843763 B1 10/2000
EP 3105392 B1 4/2017
(Continued)

OTHER PUBLICATIONS

ISA/EPO International Search Report and Written Opinion for corresponding International Application No. PCT/FR2020/052431 dated Feb. 22, 2021 (15 pages).

*Primary Examiner* — James J Buckle, Jr.
(74) *Attorney, Agent, or Firm* — Harris Beach Murtha Cullina PLLC

(57) ABSTRACT

The invention relates to a panel in the form of a strip or tile for producing of a floor covering, the panel comprising two pairs of opposite sides defining—two opposite edges for the assembly at an angle, of which one edge comprises male coupling means provided from a side wall of the panel, and an opposite edge comprises complementary female coupling means provided from a side wall of the panel; two opposite edges for vertical assembly, of which one edge comprises a male coupling means provide provided from a bottom face of the panel, and an opposite edge comprises complementary female coupling mead provided from a top face of the panel. According to the invention, the male coupling means of the edges for vertical assembly comprise two parallel groves that extend along the edge and open onto a lower face of the panel so as to define an inner male groove.

13 Claims, 3 Drawing Sheets

(52) U.S. Cl.
CPC . *E04F 2201/0161* (2013.01); *E04F 2201/023* (2013.01); *E04F 2201/042* (2013.01); *E04F 2201/043* (2013.01)

(58) Field of Classification Search
USPC ..... 52/588.1
See application file for complete search history.

(56) References Cited

U.S. PATENT DOCUMENTS 3,731,445 A * 5/1973 Hoffmann ..... E04F 15/02 52/471
6,216,409 B1 * 4/2001 Roy ..... F16B 5/008 52/592.4
6,718,721 B2 * 4/2004 Albany ..... E04C 2/292 52/794.1
7,131,242 B2 * 11/2006 Martensson ..... E04F 15/02 52/592.1
7,484,337 B2 * 2/2009 Hecht ..... E04F 15/181 52/592.1
9,938,727 B2 * 4/2018 Ceysson ..... E04F 15/02038
10,081,952 B2 * 9/2018 Bowers ..... E04F 15/22
11,421,425 B2 * 8/2022 Markovski ..... E04F 15/02038
11,834,844 B2 * 12/2023 Perra ..... E04F 15/107
2007/0022689 A1 * 2/2007 Thrush ..... E04F 13/18 52/392
2011/0247285 A1 * 10/2011 Wybo ..... B29C 66/12841 264/211.13
2014/0215946 A1 * 8/2014 Roy ..... E04F 15/02 52/309.1
2017/0175401 A1 6/2017 Kell
2017/0284105 A1 * 10/2017 Ceysson ..... E04F 15/105
2021/0381256 A1 * 12/2021 Ceysson ..... E04F 15/02038
2022/0025656 A1 * 1/2022 Carpentier ..... E04F 13/0894
2022/0341185 A1 * 10/2022 De Rick ..... E04F 15/02016
2023/0183987 A1 * 6/2023 De Rick ..... E04F 15/02038 52/582.2

FOREIGN PATENT DOCUMENTS

FR 2808824 A1 11/2001
FR 3024990 A1 2/2016
WO WO-2012/136021 A1 10/2012

* cited by examiner

[Fig. 1]
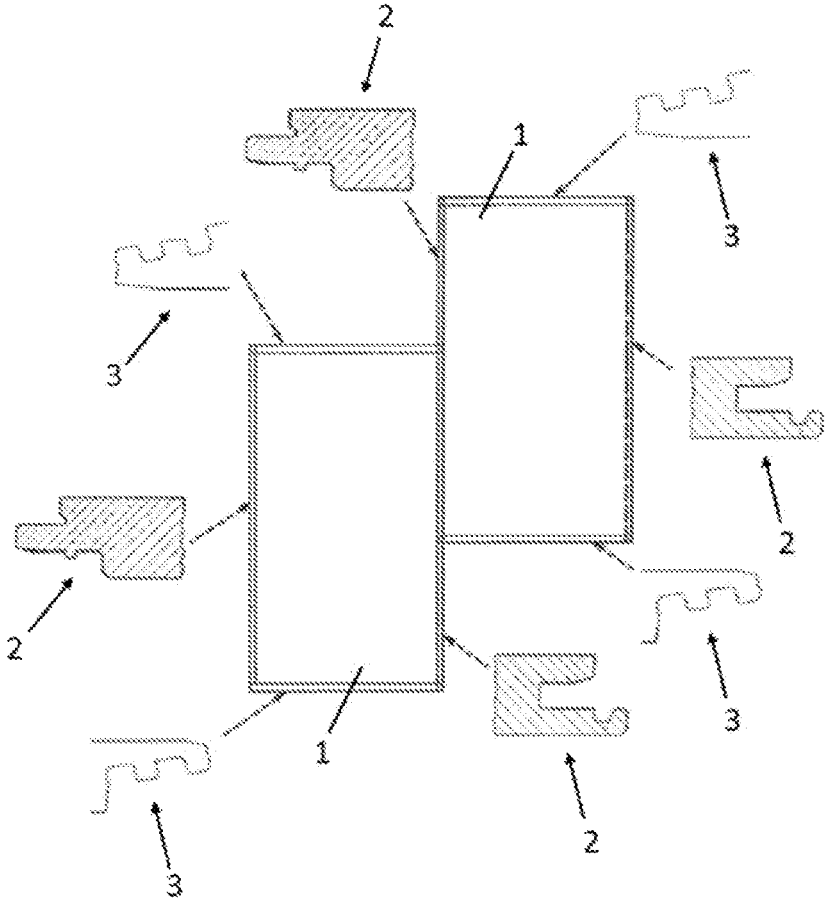
[Fig. 2]
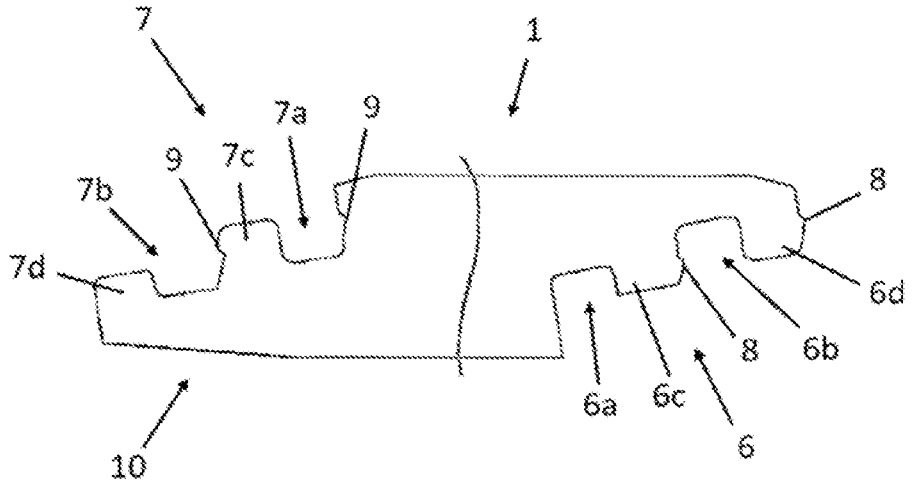

[Fig. 3]
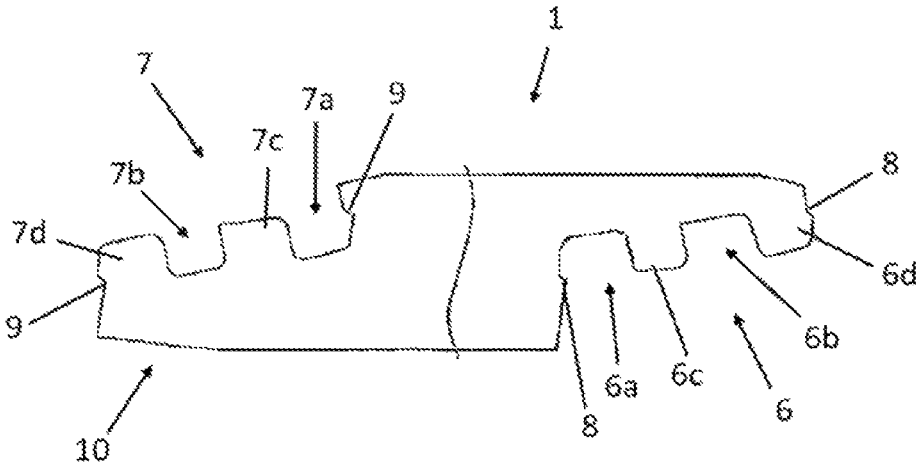
[Fig. 4]
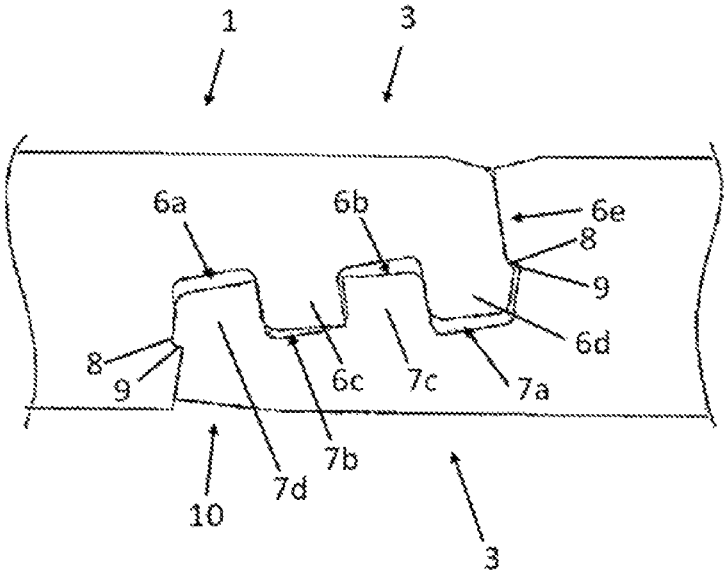

[Fig. 5]
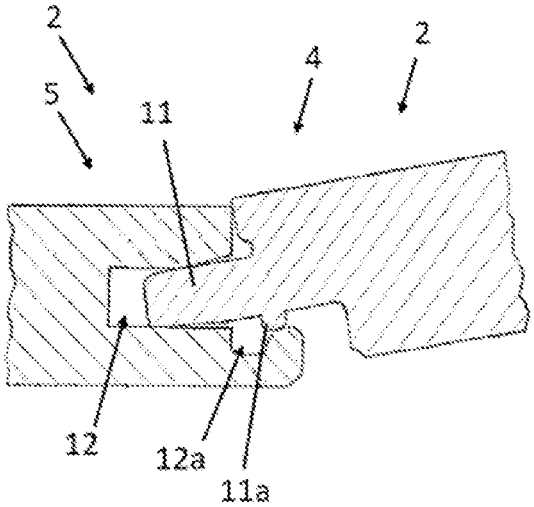
[Fig. 6]
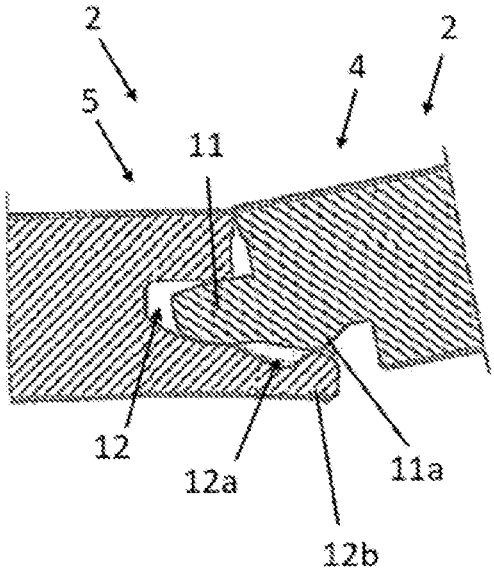

PANEL FOR PRODUCING SELF-LOCKING FLOOR COVERING

CROSS-REFERENCE TO RELATED APPLICATIONS

This application is a national stage application under 35. U.S.C. § 371 of PCT Application No PCT/FR2020/052431, filed on Dec. 14, 2020, which claims priority to and the benefit of French Application No. 1915491 filed on Dec. 23, 2019, which are incorporated herein by reference in their entirety.

TECHNICAL FIELD

The present invention relates to the field of self-locking floor coverings, and more particularly relates to a panel, preferably produced from polyvinyl chloride, being in the shape of a plank or tile, for the production of a covering of this type, wherein assembly is carried out using an inclined movement on a first edge, and a vertical movement on an adjacent second edge.

PRIOR ART

In general, this type of panel comprises two pairs of opposed sides defining:

- two opposed edges for inclined assembly, wherein one edge comprises male coupling means provided from a lateral wall of the panel, and an opposed edge comprising complementary female coupling means provided from a lateral wall of the panel;
- two opposed edges for vertical assembly, wherein one edge comprises male coupling means provided from a lower face of the panel, and an opposed edge comprising complementary female coupling means provided from an upper face of the panel.

This type of panel is illustrated, for example, by the document EP 3 105 392. This document describes a panel having complementary first and second male/female coupling means on opposed pairs of sides in order to assemble similar panels for forming a floor covering. The means for coupling the short sides have complementary means for opposing vertical uncoupling, and outer walls which are inclined with respect to a vertical plane and orientated towards the inside of the panel. Assembly is carried out by inclining the panels along a long side and by locking them vertically on a short side.

During the operation for fitting this type of floor covering, first of all, the fitter assembles the long side following an inclined direction of assembly, for example at an angle in the range 10° to 50° and then, while retaining the angle of inclination of the panel, it is then slid laterally towards the preceding panel until it comes into abutment.

It has been found that the means described in the document EP 3 105 392, in particular the edges for inclined assembly, have a tendency to slide after laying, along the assembly rotation axis, under the effect of traffic. This sliding has the effect of applying high stresses to the assembly means for vertical movement of the adjacent sides which, over time, become fragile up to breakage, or even uncoupling.

One of the means used to limit the sliding of the edges for inclined assembly consists in proposing complementary male and female assembly means comprising a flexible tongue as described in document EP 0 843 763. According to this assembly mode, the complementary groove of the female coupling means of the edges for inclined assembly defines a flexible lower female tongue which is intended to be displaced during inclined engagement of the tongue of the male coupling means, then to resume its position after engagement in order to increase the resistance of the two adjacent assembled panels to vertical and horizontal uncoupling, and also to limit the sliding along the assembly rotation axis. However, this type of solution does not allow the assembled panels to withstand the passage of heavy loads, such as the passage of forklifts. Under the effect of this type of load, the panels will tend to slide along the assembly rotation axis and/or to uncouple along the vertical axis of the sides for vertical assembly.

Another known means for limiting the uncoupling of panels having an inclined movement on a first edge, and a vertical movement on an adjacent second edge consists in gluing the panels to the support during the laying of the covering. This solution is not appropriate because the installation becomes long and complex and does not generally make it possible to withstand the passage of heavy loads, such as the passage of forklifts.

DISCLOSURE OF THE INVENTION

Thus, one of the aims of the invention is to overcome the disadvantages mentioned above by proposing a panel for producing self-locking floor covering, wherein assembly is carried out in accordance with an inclined movement on one edge, then a vertical movement on an adjacent edge.

Another aim of the invention is to provide a panel with an optimal resistance to horizontal and vertical uncoupling and possibly being able to withstand the passage of heavy loads, while having a good clipping effect as well as satisfactory appearance.

To this end, a panel has been developed with the shape of a plank or tile for the production of a floor covering, the panel comprising two pairs of opposed sides defining:

- two opposed edges for inclined assembly, wherein one edge comprises male coupling means provided from a lateral wall of the panel, and an opposed edge comprising complementary female coupling means provided from a lateral wall of the panel;
- two opposed edges for vertical assembly, wherein one edge comprises male coupling means provided from a lower face of the panel, and an opposed edge comprising complementary female coupling means provided from an upper face of the panel.

In accordance with the invention:

- the male coupling means of the edges for vertical assembly comprise two parallel grooves extending along the edge and opening onto the lower face of the panel, in a manner such as to define an inner male groove, an outer male groove, an inner male tenon, and an outer male tenon;
- the female coupling means of the edges for vertical assembly comprise two parallel grooves extending along the edge and opening onto the upper face of the panel, in a manner such as to define an inner female groove, an outer female groove, an inner female tenon, and an outer female tenon;
- the male coupling means of the edges for vertical assembly comprise two lugs and/or notches and the corresponding female coupling means comprise two complementary notches and/or lugs which, after assembly of two adjacent panels, form abutment stops to counteract a vertical displacement between two adjacent assembled panels.

Thus, the presence of the two tenons at the male and female coupling means of the sides for vertical assembly and the two pairs of lugs/notches significantly improve the resistance to the stresses due to the sliding of the sides for inclined assembly under the effect of the traffic. In the event of sliding, the risk of breakage or horizontal or vertical uncoupling of two adjacent assembled panels occurring is thus reduced. In particular, the two pairs of lugs/notches improve the resistance to vertical uncoupling and the two tenons at the level of the male and female coupling means improve the resistance to horizontal uncoupling. These new assembly means also make it possible to propose panels whose thickness can be reduced with respect to an equivalent panel while maintaining a resistance similar to traffic. In fact, the best strength of the male and female coupling means of the sides for vertical assembly enables them to be produced in a panel thickness which is 0.5 to 2 mm less than the thickness of panels in which conventional means can be machined while having equivalent resistance values to horizontal or even vertical uncoupling.

Preferably, the outer female tenon comprises a portion which is chamfered at the lower face of the panel and forms an angle of between 2° and 20° with respect to the lower face of the panel, the chamfered portion enables the outer female tenon to drop down during assembly of two adjacent panels in order to come into contact with the floor by deformation.

In order to balance the stresses in the thickness of the panel during a force of horizontal uncoupling, the outer male and female tenons have thicknesses less than or equal to the thicknesses of the inner male and female tenons. In particular, the greater thickness of the inner tenons allows to balance the two sides of the assembly means to prevent uncoupling.

The male and female tenons can be either straight or inclined with respect to the vertical towards the outside or the inside of the panel. However, in order to simplify the machining of the male and female coupling means, the male and female tenons are inclined towards the outside of the panel.

Furthermore, this feature facilitates the assembly of two panels together because the grooves open more easily when the tenons are inserted.

Preferably, the male and/or female tenons are inclined at the same angle, in order to facilitate machining, and are inclined, for example at an angle of between 1° and 45°, and preferably of between 5° and 15°.

In accordance with different embodiments, the lugs or notches are provided on an outer wall of the outer male and/or female tenon, and in a complementary manner, on an inner wall of the inner female and/or male groove.

Alternatively or in combination, the lugs or notches are provided on an outer wall of the inner male tenon, and in a complementary manner, the notches or lugs are provided on an outer wall of the inner female tenon.

Preferably, the male and female grooves of the edges for vertical assembly have outer walls intended to be in contact two by two after assembly of two adjacent panels.

In accordance with a particular embodiment, the male coupling means of the edges for inclined assembly comprise a tongue which protrudes, in particular orthogonally, from the lateral wall of the panel and over the entire length of the edge, and the female coupling means of the edges for inclined assembly comprise a complementary groove provided in the lateral wall of the panel and over the entire length of the edge.

Preferably, the tongue comprises a lug which protrudes vertically, and the complementary groove comprises a complementary notch which, after assembly of the two adjacent panels, forms abutment stops to counteract a horizontal displacement between two adjacent assembled panels.

Advantageously, the complementary groove of the female coupling means of the edges for inclined assembly defines a flexible lower female tongue which is intended to be displaced during inclined engagement of the tongue of the male coupling means, then to resume its position after engagement in order to increase the resistance of the two adjacent assembled panels to vertical and horizontal uncoupling, and thus limiting the risks of sliding of the panels between them.

BRIEF DESCRIPTION OF THE FIGURES

Other advantages and features will become apparent from the following description of several embodiments, given by way of non-limiting examples of the panel in accordance with the invention, made with reference to the accompanying drawings in which:

FIG. 1 is a diagrammatic representation of two panels in accordance with the invention, with two opposed edges for inclined assembly, and two opposed edges for vertical assembly.

FIG. 2 is a partial cross sectional view of a particular embodiment of the edges for vertical assembly.

FIG. 3 is a partial cross sectional view of another particular embodiment of the edges for vertical assembly.

FIG. 4 is a partial cross sectional view similar to that of FIG. 3, with the two panels having been assembled.

FIG. 5 is a partial cross sectional view of a particular embodiment of the edges for inclined assembly of two panels during the course of assembly.

FIG. 6 is a partial cross sectional view of another particular embodiment of the edges for inclined assembly of two panels during the course of assembly.

DETAILED DESCRIPTION OF THE INVENTION

With reference to FIGS. 1 to 6, the invention concerns a panel (1) for producing self-locking floor covering.

The floor panel (1) in accordance with the invention is preferably produced from a plastic material such as polyvinyl chloride, for example plasticized, and optionally comprising a mineral filler. Clearly, however, the panel (1) in accordance with the invention may be obtained from any appropriate plastic material.

In accordance with a particular embodiment, the panel is resilient, for example produced from plasticized or rigid polyvinyl chloride.

Preferably, the panel has a core bonded to a decorative layer constituted by a decor film bonded to a transparent surface layer.

The core may be single-layered or multi-layered and, for example, produced from a plastic material such as polyvinyl chloride, polypropylene, polyurethane, thermoplastic polyurethane, polyethylene, polyethylene terephthalate, or any other appropriate plastic material, and optionally comprising fillers in the form of fibres, chips, wood dust or sawdust and/or mineral fillers, for example chalk, lime, talc, and one or more plasticizers in order to define the rigidity of the core.

The core, or a layer of the core in the case of a multi layered core, may optionally be based on urea formaldehyde or melamine formaldehyde and wood, for example layers of medium density fibres (MDF) or high density fibres (HDF).

Each layer may also be a layer of laminated wood or wood composite (WPC, wood plastic composite).

Each layer can be compact or foamed. By way of example, the core may be produced with a foamed layer of rigid polyvinyl chloride interposed between two layers of compact rigid polyvinyl chloride.

Alternatively, the covering in accordance with the invention may also be used as a wall covering.

In a specific application, the panel (1) in accordance with the invention is used to make floor coverings and is advantageous in that it includes a pair of sides for vertical assembly having an optimal resistance to horizontal uncoupling, i.e., for example, greater than 660 N/10 cm, allowing it in particular to withstand the passage of heavy loads, such as the passage of forklifts.

In known manner, the panel (1) comprises a rectangular shape and comprises two pairs of opposed sides defining four edges, of which two opposed edges are for inclined assembly (2), and two other opposed edges for vertical assembly (3). Clearly, the panel (1) may also be square in shape.

From the foregoing, assembly of this type of panel (1) is carried out in accordance with an inclined movement on a first edge (2), for example at an angle of between 10° and 50°, and in accordance with a vertical movement on an adjacent second edge (3).

In particular, when fitting this type of panel (1), the fitter fits a first line of panels (1), by assembling them side by side in a vertical assembly movement. Next, the fitter starts a second line of panels (1) by assembling a first panel (1), in accordance with a movement which is inclined with respect to the panels (1) of the preceding line. The panels (1) of the second line are assembled in accordance with a movement which is inclined with respect to the panels (1) of the preceding line and, by a pivoting movement of the panel (1) in the direction of the floor, the panel (1) is assembled with the adjacent panel (1) in accordance with a vertical movement.

Preferably, when the panels (1) are rectangular in shape, the long sides are assembled in accordance with an inclined movement, while the short sides are assembled in accordance with a vertical movement. It is in fact observed that the edges for vertical assembly in accordance with the invention require an installation with mallet in order to be able to apply the force necessary for their assembly. In fact, it is preferable for these edges to be the shortest so as not to make the fitting too tedious or to require too much effort.

In accordance with the invention and with reference to FIGS. 2 to 4, the male coupling means (6) of the edges for vertical assembly (3) comprise two parallel grooves extending along the edge and opening onto a lower face of the panel (1), so as to define an inner male groove (6*a*), an outer male groove (6*b*), an inner male tenon (6*c*), and an outer male tenon (6*d*). By "inner" is meant at the side of the body of the panel (1) inward, and by "outer" is meant at the side of the outside of the panel (1).

In the same manner, the female coupling means (7) of the edges for vertical assembly (3) comprise two parallel grooves extending along the edge and opening onto an upper face of the panel, so as to define an inner female groove (7*a*), an outer female groove (7*b*), an inner female tenon (7*c*), and an outer female tenon (7*d*).

The male (6*c*, 6*d*) and female (7*c*, 7*d*) tenons comprise substantially rectangular cross-sections, and are flexible and elastically deformable to allow their engagement into the corresponding female (7*a*, 7*b*) and male (6*a*, 6*b*) grooves. Preferably, the inner and outer walls of the inner female tenons (7*c*) and/or the inner and outer walls of the inner male tenons (6*c*) have an inclination difference of less than 15°, preferably less than 5°, between the inner and outer walls of the same tenon, in order to facilitate their machining. More preferably, the inner and outer walls of the inner female (7*c*) and/or inner male tenons (6*c*) of the same tenon are parallel. The assembly and horizontal locking of the coupling means is optimized when the inner and outer walls of the inner female (7*c*) and inner male (6*c*) tenons are all parallel.

From the above and with reference to FIG. 4, when assembling two panels (1) together, the male coupling means (3) of the edges for vertical assembly (3) of a first panel (1) are intended to engage the female coupling means (7) of the edges for vertical assembly (3) of a second panel (1), in particular in accordance with a vertical movement.

The presence of the two tenons at the male (6) and female (7) coupling means of the edges for vertical assembly (3) allows to significantly improve the force required for the horizontal uncoupling of two panels (1). Horizontal uncoupling means exerting a tensile strength on each of the panels (1), parallel to the plane defined by the panels (1), in order to move them apart from each other. Such tensile strength is exerted, for example, for a floor covering, when heavy loads travel over two adjacent panels (1), at the boundary between said two panels (1), for example the passage of a forklift.

In order to further improve the resistance to horizontal uncoupling of two panels (1) and with reference to FIG. 4, the male (6*a*, 6*b*) and female (7*a*, 7*b*) grooves of the edges for vertical assembly (3) each have outer walls, i.e. positioned not on the side of the body of the panel (1), but positioned on the side of the outside of the panel (1), intended to be in contact two by two, after assembly of the two panels (1). In order to obtain the contact two by two, the grooves and tenons have appropriate widths and/or inclinations. By way of example, the tenons and grooves have widths of the order of 2 mm, and are inclined by 5° with respect to the vertical and towards the outside of the panel. More specifically, the panel shown in FIG. 4 has an outer female tenon (7*d*) with a width of 2.02 mm, an inner female tenon (7*c*) with a width of 1.95 mm, an inner male groove (6*a*) with a width of 2 mm, and an outer male groove (6*b*) with a width of 1.98 mm.

The contact two by two means that the outer walls of the male grooves (6*a*, 6*b*) are in contact with the outer walls of the female grooves (7*a*, 7*b*). In practice, after assembly, these walls which are in contact are parallel to each other. After assembly, and preferably, at least one male tenon (6*c*, 6*d*) is in contact with the bottom of the corresponding female groove (7*b*, 7*a*) for vertical abutment. Furthermore, after assembly, there is preferably a clearance of a few tenths of a millimetre between the outer vertical wall of the outer female tenon (7*d*), located below the notch (9), and the vertical wall facing the inner male groove (6*a*), located below the lug (8). This feature can facilitate assembly.

Finally, the male coupling means (6) of the edges for vertical assembly (3) comprise two lugs (8) and/or notches (9) and the corresponding female coupling means comprise two complementary notches (9) and/or lugs (8) which, after assembly of two adjacent panels, form abutment stops to counteract a vertical displacement between two adjacent assembled panels.

Thus, several embodiments may be envisaged. For example, the male coupling means (3) of the edges for vertical assembly (3) comprise either two lugs (8), or two notches (9), or a lug (8) and a notch (9), formed to cooperate in a complementary manner with either two notches (9), or two lugs (8), or a notch (9) and a lug (8), provided on the female coupling means (7) for the edges for vertical assembly (3).

For example, the lugs (8) or notches (9) are provided on an outer wall of the outer male (6*d*) and/or female (7*d*) tenon, and in a complementary manner on an inner wall of the inner female (7*a*) and/or male (6*a*) groove.

Furthermore, in combination, the lugs (8) or notches (9) are, for example, provided on an outer wall of the inner male tenon (6*c*), and in a complementary manner, the notches (9) or lugs (8) are provided on an outer wall of the inner female tenon (7*c*).

Therefore, according to a first embodiment illustrated in FIG. 2, the male coupling means (6) comprise a lug (8) provided on the outer wall of the inner male tenon (6*c*), and a lug (8) provided on the outer wall of the outer male tenon (6*d*) and, in a complementary manner, the female coupling means (7) comprise a notch (9) provided on an outer wall of the inner female tenon (7*c*), and a notch (9) provided on an inner wall of the inner female groove (7*a*).

In a second embodiment illustrated in FIG. 3, the male coupling means (6) comprise a lug (8) provided on the outer wall of the outer male tenon (6*d*), and a lug (8) provided on the inner wall of the inner male groove (6*a*) and, in a complementary manner, the female coupling means (7) comprise a notch (9) provided on an inner wall of the inner female groove (7*a*), and a notch (9) provided on an outer wall of the outer female tenon (7*d*).

Of course, other embodiments can be considered with different notches (9)/lugs (8) combinations, without mowing away from the scope of the invention.

According to another feature of the invention, the outer female tenon (7*d*) comprises a chamfered portion (10) at the level of the lower face of the panel (1) and forming an angle comprised between 2° and 20° with the lower face of the panel (1). Thus, the chamfered portion (10) enables the outer female tenon (7*d*) to drop down during assembly of two adjacent panels (1) in order to come into contact with the floor by deformation and therefore ensure a reduction in the force of assembly. The chamfered portion (10) can extend below the outer female tenon (7*d*), or even below the outer female groove (7*b*), or even up to the inner female groove (7*a*), in order to facilitate the assembly by increasing the flexibility of the whole.

Furthermore, the upper face of the panel (1) may also have chamfers at the level of the outer male tenon (6*b*) of the edges for vertical assembly (3) and of the inner female groove (7*a*) in order to contribute to the general aesthetic appearance of the panels (1) after assembly. Each chamfer forms an angle comprised between 2° and 20° with respect to the upper face of the panel (1). The interface between the two assembled panels thus forms a V-shaped groove, shown in FIG. 4.

In order to facilitate the assembly of two adjacent panels (1), and in particular the engagement of the male coupling means (6) inside the female coupling means (3), the male (6*c*, 6*d*) and female (7*c*, 7*d*) tenons are inclined with respect to the vertical and towards the outside or inside of the panel (1). This feature also means that manufacture is facilitated, and in particular machining of the male (6) and female (7) coupling means. In a particular case, the male (6*c*, 6*d*) and female (7*c*, 7*d*) tenons could form a sort of dovetail, the outer faces being inclined towards the outside and the inner faces towards the inside of the panel.

An inclination with respect to the vertical of the male (6*c*, 6*d*) and female (7*c*, 7*d*) tenons towards the outside of the panel of between 1° and 45°, preferably between 5 and 15° enables a good compromise to be obtained between the ease of assembly of the panels and the resistance to horizontal uncoupling of the vertical coupling means (3). Thus, during engagement of the male tenons (6*c*, 6*d*) in the female grooves (7*a*, 7*b*) in accordance with a vertical movement, the outer wall (6*e*) of the outer male tenon (6*d*) will come into abutment with the inner wall of the inner female groove (7*a*) and the outer wall of the outer female tenon (7*d*) will come into abutment with the inner wall of the inner male groove (6*a*). As a consequence, during the fitting operation, the fitter can see the female groove (7*a*) and can therefore easily position the outer wall (6*e*) of the outer male tenon (6*d*) level with the inner female groove (7*a*) in order to commence assembly. This very substantially facilitates the vertical assembly operation during the rotational movement. Furthermore, and in an advantageous manner, given the inclination towards the outside of the outer wall (6*e*) of the outer male tenon (6*d*) and the complementary inclination of the inner wall of the inner female groove (7*a*), the two panels (1) approach each other during pivoting. This further facilitates the fitting operation and machining constraints which are involved in the production of a perfect contact at the surface of the panels (1) are also easier to accommodate.

In accordance with different embodiments, the male tenons (6*c*, 6*d*) of the edges for vertical assembly (3) are inclined at the same angle, for example of between 1 and 45°, and preferably between 5 and 15°. In the same manner, and according to a particular embodiment, the female tenons (7*c*, 7*d*) of the edges for vertical assembly (3) are inclined at the same angle, for example also comprised between 1 and 45°, and preferably between 5 and 15°. Finally, in accordance with a particular embodiment, the male tenons (6*c*, 6*d*) are inclined at the same angle as the female tenons (7*c*, 7*d*). In FIGS. 2 to 4, the inclination of the male (6*c*, 6*d*) and female (7*c*, 7*d*) tenons is 5°.

In order to further contribute to the resistance to the horizontal uncoupling, and to also balance the stresses in the thickness of the panel (1) during such a force of uncoupling, the outer male (6*d*) and female (7*d*) tenons of the edges for vertical assembly (3) have thicknesses less than or equal to the thicknesses of the inner male (6*c*) and female (7*c*) tenons. In other words, the inner tenons (6*c*, 7*c*) are thicker than the outer tenons (6*d*, 7*d*). Thickness means the height, or the distance between the lower face and the upper face of the panel (1), at the level of said tenons.

Another way of characterizing the thickness or height of the tenons is to characterize the thickness of the panel (1) between the upper face of the panel (1) and the bottom of the male grooves (6*a*, 6*b*) for the male coupling means (6), and the thickness between the lower face of the panel (1) and the bottom of the female grooves (7*a*, 7*b*) for the female coupling means (7) of the edges for vertical assembly (3). Thus, for the female coupling means (7), the thickness between the lower face of the panel (1) and the bottom of the outer female groove (7*b*) is less than the thickness between the lower face of the panel (1) and the bottom of the inner female groove (7*a*). In the same manner, for the male coupling means (6), the thickness between the upper face of the panel (1) and the bottom of the outer male groove (6*b*) is less than the thickness between the upper face of the panel (1) and the bottom of the inner male groove (6*a*).

The invention preferably applies to a panel (1) having a thickness greater than 4 mm, and preferably comprised between 5 and 10 mm, or even greater.

In general, the shortest distance or thickness between the bottom of the male (6*a*, 6*b*) or female (7*a*, 7*b*) grooves of the edges for vertical assembly (3) and the corresponding upper or lower face of the panel (1) is comprised between 20% and 60% of the thickness of the panel (1). In accordance with a particular example, the thickness at the bottom of the outer grooves (6*b*, 7*b*) is comprised between 20% and 45% of the thickness of the panel (1), and the thickness at the bottom of the inner grooves (6*a*, 7*a*) is comprised between 20 and 60% of the thickness of the panel (1).

For example, for a panel (1) with a thickness of 6 mm and coupling means as shown in FIG. 2, the thickness at the bottom of the outer female groove (7*b*) is 1.85 mm, while the thickness at the bottom of the inner female groove (7*a*) is 3.08 mm. The thickness at the bottom of the outer male groove (6*b*) is 1.4 mm, while the thickness at the bottom of the inner male groove (6*a*) is 3.08 mm.

Always for example, for a panel (1) with a thickness of 6 mm and coupling means as shown in FIG. 3, the thickness at the bottom of the outer female groove (7*b*) is 2.37 mm, while the thickness at the bottom of the inner female groove (7*a*) is 3.11 mm. The thickness at the bottom of the outer male groove (6*b*) is 2.34 mm, while the thickness at the bottom of the inner male groove (6*a*) is 2.66 mm.

In accordance with a particular embodiment, the thicknesses of the male coupling means (6) of the edges for vertical assembly (3) at the bottoms of the male grooves (6*a*, 6*b*) are equal to the thicknesses of the female coupling means (7) of the edges for vertical assembly (3) at the bottoms of the female grooves (7*a*, 7*b*).

With reference to FIGS. 5 and 6, the opposed edges for vertical assembly (2) consist of an edge comprising male coupling means (4) provided from a lateral wall of the panel (1), and of an opposed edge comprising complementary female coupling means (5) provided from a lateral wall of the panel (1).

In accordance with the invention and with reference to FIG. 5, the male coupling means (4) of the edges for inclined assembly (2) comprise a tongue (11) which protrudes from the lateral wall of the panel (1) and over the entire length of the edge. The female coupling means (5) of the edges for inclined assembly (2) comprise a complementary groove (9) provided in the lateral wall of the panel (1) and over the entire length of the edge.

The cooperation between the tongue (11) and the groove (12) means that vertical uncoupling of the two panels (1) can be resisted in an optimal manner.

In order to resist horizontal uncoupling, the tongue (11) comprises a lug (11*a*) which protrudes vertically, and the complementary groove (12) comprises a complementary notch (12*a*) which, after assembly of two adjacent panels (1), forms stop abutments to counteract a horizontal displacement between two adjacent assembled panels (1). Clearly, the tongue (11) may comprise a notch and the groove (12) may comprise a lug without departing from the scope of the invention.

As mentioned above, engagement of the tongue (11) in the groove (12) occurs in accordance with an inclined movement, then by pivoting the panel (1), the tongue (11) is displaced horizontally towards the bottom of the groove (12).

In accordance with another embodiment of the opposed edges for inclined assembly (2) illustrated in FIG. 6, the complementary groove (12) of the female coupling means (5) defines a flexible lower female tongue (12*b*) which is intended to be displaced during inclined engagement of the tongue (11) of the male coupling means (4), then to resume its position after engagement in order to increase the resistance to vertical and horizontal uncoupling of two adjacent assembled panels (1).

Strength tests were performed with male (6) and female (7) coupling means of the edges for vertical assembly (3) having thicknesses of 1.4 mm at the bottoms of the outer grooves (6*b*, 7*b*), and thicknesses of 2.8 mm at the bottoms of the inner grooves (6*a*, 7*a*). A resistance to vertical uncoupling of 1000 N/10 cm, and a resistance to horizontal uncoupling of 670 N/10 cm were measured. The mechanical properties of horizontal and vertical uncoupling were determined according to ISO24344 on a Shimadzu Autograph AGS-X tensile tester, on 10 cm by 10 cm samples, at a speed of 10 mm/min.

To measure the force of vertical uncoupling, the stress is applied perpendicular to the plane formed by the assembled floor covering. The force used is the one observed during the complete uncoupling of the assembly means.

To measure the force of horizontal uncoupling, the stress is applied along the plane formed by the assembled floor covering. The force used is the one observed during the complete uncoupling of the assembly means.

It is apparent from the foregoing that the invention in fact provides a panel (1) for which assembly is carried out using an inclined movement on one edge, and a vertical movement on an adjacent edge for which assembly is facilitated, and having an optimal resistance to horizontal and vertical uncoupling, optionally to withstand the passage of heavy loads, while having a good clipping effect as well as a satisfactory aesthetic appearance.

The invention claimed is:

1. A panel having the shape of a plank or a tile for the production of a floor covering, the panel comprising two pairs of opposed sides defining:

two opposed edges for inclined assembly, wherein one edge comprises male coupling means provided from a lateral wall of the panel, and an opposed edge comprising complementary female coupling means provided from a lateral wall of the panel;

two opposed edges for vertical assembly, wherein one edge comprises male coupling means provided from a lower face of the panel, and an opposed edge comprising complementary female coupling means provided from an upper face of the panel;

characterized in that:

the male coupling means of the edges for vertical assembly comprise two parallel grooves extending along the edge and opening onto the lower face of the panel, in a manner such as to define an inner male groove, an outer male groove, an inner male tenon, and an outer male tenon;

the female coupling means of the edges for vertical assembly comprise two parallel grooves extending along the edge and opening onto the upper face of the panel, so as to define an inner female groove, an outer female groove, an inner female tenon, and an outer female tenon;

the male coupling means of the edges for vertical assembly comprise two lugs and/or notches and the corresponding female coupling means comprise two complementary notches and/or lugs which, after assembly of two adjacent panels, form abutment stops to counteract a vertical displacement between two adjacent assembled panels characterized in that:

the male coupling means of the edges for inclined assembly comprise a tongue which protrudes from the lateral wall of the panel and over the entire length of the edge, and the female coupling means of the edges for inclined assembly comprise a complementary groove provided in the lateral wall of the panel and over the entire length of the edge.

2. A panel according to claim 1, characterized in that the outer female tenon comprises a chamfered portion at the lower face of the panel and forming an angle of comprised between 2° and 20° with respect to the lower face of the panel, the chamfered portion enabling the outer female tenon to drop down during assembly of two adjacent panels in order to come into contact with the floor by deformation.

3. A panel according to claim 1, characterized in that the outer male and female tenons have thicknesses less than or equal to the thicknesses of the inner male and female tenons.

4. A panel according to claim 1, characterized in that the male and female tenons are inclined with respect to the vertical and towards the outside of the panel.

5. A panel according to claim 4, characterized in that the male and/or female tenons are inclined at the same angle.

6. A panel according to claim 4, characterized in that the male and/or female tenons are inclined at an angle comprised between 1° and 45°.

7. A panel according to claim 1, characterized in that the lugs or notches are provided on an outer wall of the outer male and/or female tenon, and in a complementary manner, on an inner wall of the inner female and/or male groove.

8. A panel according to claim 1, characterized in that the lugs or notches are provided on an outer wall of the inner male tenon, and in a complementary manner, the notches or lugs are provided on an outer wall of the inner female tenon.

9. A panel according to claim 1, characterized in that the male and female grooves of the edges for vertical assembly have outer walls intended to be in contact two by two after assembly of two adjacent panels.

10. A panel according to claim 1, characterized in that the tongue comprises a lug which protrudes vertically, and the complementary groove comprises a complementary notch which, after assembly of two adjacent panels, forms abutment stops to counteract a horizontal displacement between two adjacent assembled panels.

11. A panel according to claim 1, characterized in that the groove defines a flexible lower female tongue which is intended to be moved away from the upper face of the panel during inclined engagement of the tongue of the male coupling means, then to resume its position after engagement in order to increase the resistance of the two adjacent assembled panels to vertical and horizontal uncoupling.

12. A panel according to claim 10, characterized in that the groove defines a flexible lower female tongue which is intended to be moved away from the upper face of the panel during inclined engagement of the tongue of the male coupling means, then to resume its position after engagement in order to increase the resistance of the two adjacent assembled panels to vertical and horizontal uncoupling.

13. A panel according to claim 6, characterized in that the male and/or female tenons are inclined at an angle comprised between 5° and 15°.

* * * * *